United States Patent [19]

Laemmle et al.

[11] 4,396,436

[45] Aug. 2, 1983

[54] METHOD AND FLUSHING FOR REMOVING HYDRAULIC FLUID FROM HYDRAULIC SYSTEMS

[75] Inventors: Joseph T. Laemmle, Delmont; William E. Boren, Lower Burrell, both of Pa.

[73] Assignee: Aluminum Company of America, Pittsburgh, Pa.

[21] Appl. No.: 284,731

[22] Filed: Jul. 20, 1981

[51] Int. Cl.[3] ..... B08B 3/08

[52] U.S. Cl. ..... 134/12; 134/22.12; 134/22.14; 134/22.18; 134/22.19; 134/40; 134/32.7 E; 134/78.1; 134/171; 134/15

[58] Field of Search ..... 134/12, 22.11, 22.14, 134/22.19, 40, 22.12, 22.18; 252/163, 172, 32.7 E, 78.1, 162, 170, 171; 188/352; 137/15; 536/100; 106/190

[56] References Cited

U.S. PATENT DOCUMENTS

| | | | |
|---|---|---|---|
| 2,160,911 | 6/1939 | Russell | 252/163 |
| 2,327,701 | 8/1943 | Ellis et al. | 252/163 |
| 2,528,347 | 10/1950 | Denison, Jr. et al. | 252/78.1 |
| 3,114,710 | 12/1963 | Calhoun | 252/32.7 E |
| 3,149,077 | 9/1964 | Davis | 252/32.7 E |
| 3,385,735 | 5/1968 | Brabrand et al. | 134/28 |
| 3,391,084 | 7/1968 | York | 134/40 |
| 3,415,755 | 12/1968 | Luck | 252/171 |
| 3,434,881 | 3/1969 | Smith | 134/12 |
| 3,634,273 | 1/1972 | Marsh et al. | 252/170 |
| 3,766,075 | 10/1973 | Jackson | 252/163 |
| 3,848,004 | 12/1974 | Katsuragawa et al. | 260/652.5 R |
| 4,017,329 | 4/1977 | Larson | 134/21 |
| 4,023,934 | 5/1977 | Clementson et al. | 134/38 |
| 4,046,820 | 9/1977 | Goodner et al. | 260/652.5 R |
| 4,179,384 | 12/1979 | Mann | 252/32.7 E |
| 4,194,924 | 3/1980 | Safranko et al. | 134/12 |
| 4,229,572 | 10/1980 | Zweigle | 536/100 |

*Primary Examiner*—William F. Smith

*Attorney, Agent, or Firm*—Douglas G. Glantz; Glenn E. Klepac

[57] ABSTRACT

A method for removing residual hydraulic fluid from hydraulic systems employing a flushing fluid comprising a thickening agent dissolved in an organic solvent having a boiling point below about 125° C. After draining fluid from a hydraulic system, flushing fluid is injected into the system and circulated to dissolve residual fluid. The flushing fluid, containing dissolved residual fluid, is then drained from the system. In a preferred embodiment, the flushing fluid comprises about one to three percent by weight ethyl cellulose dissolved in 1,1,1-trichloroethane together with about 0.1 to six percent by weight of a friction-reducing antiwear additive.

15 Claims, No Drawings

METHOD AND FLUSHING FOR REMOVING HYDRAULIC FLUID FROM HYDRAULIC SYSTEMS

BACKGROUND OF THE INVENTION

This invention relates to an efficient and economical method for removing residual hydraulic fluid from hydraulic systems and to the composition of a flushing fluid for accomplishing such removal. In the past, fire-resistant hydraulic fluids containing polychlorinated biphenyls (PCB's) have been used in hydraulic systems. However, in recent times regulations of the federal Environmental Protection Agency have mandated disposal of such fluids because of the carcinogenic potential of PCB's.

In order to accomplish the removal of PCB-containing hydraulic fluid from hydraulic systems in a thorough manner, a flushing fluid has been added to the systems and circulated. Prior to the present invention, the flushing fluid of choice has been hydraulic fluid not containing any PCB's. However, usage of such fluid for flushing suffers the disadvantages of being relatively expensive and requiring long-term storage of large volumes of PCB-containing material.

Various types of solvents have been used in the past for flushing or cleaning hydraulic systems, but each of these prior art solvents suffers from one or more serious disadvantages making it less than completely suitable for accomplishing the objectives of the present invention. Larson U.S. Pat. No. 4,017,329 discloses a method for flushing hydraulic systems with liquid dichlorodifluoromethane under a pressure of about 70 psi at 70° F. Braband et al. U.S. Pat. No. 3,385,735 claims a method for cleaning hydraulic systems relying upon alternate washings with a cleaning solution containing an alkaline inorganic compound or synthetic detergent and a solution containing an inorganic or organic acid.

Some other patents disclosing flushing fluids or cleaning solutions different from the ones claimed herein are as follows: Katsuragawa et al. U.S. Pat. No. 3,848,004 (liquid 1,1,1-trichloroethane stabilized by addition of 1,4-dioxane, acrylonitrile, ethyl acetate and nitromethane to prevent rusting of aluminum, iron, zinc and copper); Clementson et al. U.S. Pat. No. 4,023,984 (method for cleaning printed circuit boards using a mixture 1,1,1-trichloroethane and isopropanol); Goodner et al. U.S. Pat. No. 4,046,820 (1,1,1-trichloroethane containing trichloroethylene or fluorene as a free radical scavenging agent to prevent rusting of aluminum or other metals); Safranko et al. U.S. Pat. No. 4,194,924 (method for recovering residual low flash point jet fuel from an aircraft fuel tank by flushing with a high flash point hydrocarbon purging liquid).

While the solvents described in the above patents may be effective for dissolving residual fluids in the systems where they are used, none of the solvents known in the prior art has sufficient viscosity to avoid damaging pumps in hydraulic systems.

It is a principal object of the present invention to provide a method for flushing hydraulic systems that avoids damage to the pumps in such systems.

A further objective of the invention is to provide a method for flushing hydraulic systems wherein the volume of resulting waste material flushed from such systems is less than in prior art methods.

It is a related objective of the invention to provide a method for flushing hydraulic systems that prevents excessive wear on metal surfaces of components in such systems.

Another objective of the invention is to provide a flushing fluid that is a solvent for hydraulic fluid, has sufficient viscosity to avoid damaging hydraulic pumps and prevents excessive wear on surfaces of metal components in hydraulic systems.

Additional objects and advantages of the present invention will become apparent to persons skilled in the art from the following specification.

SUMMARY OF THE INVENTION

In accordance with the present invention, a flushing fluid is made up by dissolving a thickening agent in an organic solvent having a boiling point below about 125° C. Organic solvents having boiling points of about 40° to 100° C. are preferred. The organic solvent may be selected from the group consisting of halogenated $C_1$–$C_6$ aliphatic hydrocarbons, benzene and toluene. If desired, mixtures of two or more solvents may be employed.

Some preferred solvents are 1,1,1-trichloroethane, tetrachloroethene and trichloromethane. The solvent used in a particularly preferred embodiment is 1,1,1-trichloroethane.

The thickening agent dissolved in the organic solution of the invention may be an organic polymer. A preferred thickening agent is ethyl cellulose. The thickening agent is present in an amount of less than about 10 percent by weight of the solvent and, preferably, about one to three percent. A solution containing two percent by weight T-b 200 ethyl cellulose in 1,1,1-trichloroethane has been found quite suitable.

A third ingredient in the preferred flushing fluid of the invention is a friction-reducing antiwear additive.

Some preferred antiwear additives are organic phosphates, such as tricresyl phosphate and zinc dithiophosphate; organic phosphites; lead soaps, such as lead naphthenate; and molybdenum salts, such as ammonium molybdate.

The friction-reducing additive comprises about 0.1 to six percent by weight of the organic solution. Concentrations of the additive are ordinarily less than one percent by weight of the organic solution. A concentration of about 0.4% by weight has been found suitable in a particularly preferred embodiment.

The method of the present invention is practiced by initially draining hydraulic fluid from a hydraulic system, then injecting into the system an organic solution as described above. The solution is circulated throughout the system using hydraulic pumps, thereby dissolving any residual hydraulic fluid remaining in the system. The system is then drained, removing the organic solution which contains dissolved residual hydraulic fluid.

In a preferred embodiment, organic solution drained from the system is distilled by evaporating the solvent, thereby reducing the volume of material to be stored. Organic solvent distilled from the solution may then be recycled by being used to make up a new solution containing dissolved thickening agent.

DETAILED DESCRIPTION OF A PREFERRED EMBODIMENT

In a preferred embodiment of the invention, an organic solution has been made up by dissolving two parts by weight T-200 type ethyl cellulose in 98 parts by weight 1,1,1-trichloroethane. The ethyl cellulose is an organic polymeric thickening agent which adds viscosity to the solution, thereby preventing damage to pumps when the solution is circulated through a hydraulic system.

The term "T-200" refers to an ethyl cellulose having an ethoxyl content of about 49 to 50% on a weight basis, or about 2.53 to 2.60 ethoxyl units per anhydroglucose unit. A five-percent solution of T-200 ethyl cellulose in 80 parts toluene and 20 parts ethanol has a viscosity of about 200 cps at 25° C. When T-200 ethyl cellulose is used, the amount of ethyl cellulose dissolved in organic solvent is less than about 10 percent by weight. A greater concentration of thickening agent may be needed if the ethyl cellulose has fewer ethoxyl units or a lower viscosity or if a different thickening agent is selected.

The organic solvent may be selected from the group consisting of halogenated $C_1$–$C_6$ aliphatic hydrocarbons, benzene and toluene. Some preferred solvents are 1,1,1-trichloroethane, tetrachloroethene and trichloromethane. The solvent has a boiling point of less than 125° C. and, preferably, about 40° to 100° C. Other preferred thickening agents may be used to increase viscosity so long as such agents are soluble in the particular solvent selected.

In order to prevent excessive wear on components of the hydraulic system, a friction-reducing antiwear additive is dissolved in the flushing fluid. Some preferred friction-reducing additives are organic phosphates, such as tricresyl phosphate and zinc dithiophosphate; organic phosphites; lead soaps, such as lead naphthenate; and molybdenum compounds, such as ammonium molybdate. Depending upon the degree of friction in the hydraulic system, these additives may be present in amounts ranging from about 0.1 to six percent by weight in the solution described above. A particularly preferred solution includes 0.4 parts by weight zinc dithiophosphate dissolved in 100 parts by weight of the solution described above.

A flushing fluid made up in accordance with the present invention has been tested by mixing 100 parts by weight of a solution containing 98 parts by weight of 1,1,1-trichloroethane and two parts by weight ethyl cellulose together with five parts by weight of a hydraulic fluid having the trade designation PYDRAUL 50E. The hydraulic fluid is a typical hydraulic fluid containing a phosphate ester, in this case an alkyl substituted triaryl phosphate.

The test was performed by circulating the solution for 24 hours at a pump pressure of 800 psi and a temperature of between 106° and 112° F. No damage was caused to the hydraulic pump by circulating the solution through the system although some wear on metal components was thought to have occurred because of the absence of any friction-reducing additive.

Organic solution containing residual hydraulic fluid is drained from the system. The solution thus recovered can be stored as drained or can be condensed in volume by evaporating organic solvent that is later recovered by distillation. The distilled solvent may then be recycled by being used to make up additional solution that is injected into another system to be cleaned.

The method of the present invention has the advantage of being lower in cost than prior art methods wherein hydraulic fluid is used for flushing. At current prices, 1,1,1-trichloroethane is much lower in price than hydraulic fluid. An additional advantage of the present invention is that the 1,1,1-trichloroethane may be recovered by distillation because its boiling point is only about 74° C. After the 1,1,1-trichloroethane is distilled, the volume of resulting waste material is less than in prior art methods wherein fresh hydraulic fluid was used to flush the systems.

With the foregoing detailed description of a preferred embodiment of our invention in mind, numerous changes and modifications will occur to persons skilled in the art without departing from the spirit and scope of the following claims.

What is claimed is:

1. A method for flushing residual hydraulic fluid from a hydraulic system, comprising the steps of (a) draining hydraulic fluid from the system;

(b) injecting into the system an organic solution comprising a thickening agent of ethyl cellulose dissolved in an organic solvent of chlorinated hydrocarbon having a boiling point below about 125° C., said hydraulic fluid being soluble in said organic solution;

(c) circulating the organic solution through the system under an elevated pressure above atmospheric by pumping to dissolve any residual hydraulic fluid contained therein; and (d) draining the organic solution from the system.

2. The method of claim 1 further comprising (e) evaporating the organic solvent from the organic solution recovered in step (d).

3. The method of claim 2 further comprising (f) recycling to step (b) organic solvent recovered in step (e).

4. The method of claim 1 wherein said thickening agent consists essentially of ethyl cellulose having an ethoxyl content greater than about 49% by weight.

5. The method of claim 1 wherein said thickening agent is present in an amount less than about 10% by weight.

6. The method of claim 5 wherein said thickening agent is present in an amount of about one to three percent by weight.

7. The method of claim 1 wherein said organic solvent has a boiling point of about 40° to 100° C.

8. The method of claim 1 wherein said organic solvent is selected from the group consisting of 1,1,1-trichloroethane, tetrachloroethene and trichloromethane.

9. The method of claim 8 wherein said organic solvent is 1,1,1-trichloroethane.

10. The method of claim 1 wherein said organic solution further comprises about 0.1 to 6% by weight of a friction-reducing additive.

11. A solution useful, as a flushing fluid for hydraulic systems, said solution comprising (a) a chlorinated hydrocarbon solvent having a boiling point below about 125° C. for hydraulic fluid;

(b) an organic polymeric thickening agent of ethyl cellulose dissolved in said solvent in an amount less than about 10% by weight of said solution; and (c) about 0.1 to 6% by weight of a friction-reducing additive soluble in said solvent.

12. The solution of claim 11 wherein said organic solvent is 1,1,1-trichloroethane.

13. The solution of claim 11 wherein said thickening agent is ethyl cellulose having an ethoxyl content greater than 49% by weight.

14. Claim 9 or claim 12 wherein said hydraulic fluid comprises polychlorinated biphenyl.

15. Claim 10 or claim 13 wherein said friction-reducing additive comprises zinc dithiophosphate.

* * * * *